US010229635B2

(12) United States Patent
Kim

(10) Patent No.: US 10,229,635 B2
(45) Date of Patent: Mar. 12, 2019

(54) ORGANIC LIGHT EMITTING DISPLAY DEVICE

(71) Applicant: LG Display Co., Ltd., Seoul (KR)

(72) Inventor: Joon Young Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 408 days.

(21) Appl. No.: 14/468,586

(22) Filed: Aug. 26, 2014

(65) Prior Publication Data

US 2015/0179107 A1 Jun. 25, 2015

(30) Foreign Application Priority Data

Dec. 23, 2013 (KR) ..... 10-2013-0160930

(51) Int. Cl.
*G09G 3/3233* (2016.01)

(52) U.S. Cl.
CPC ..... *G09G 3/3233* (2013.01); *G09G 2300/043* (2013.01); *G09G 2300/0819* (2013.01); *G09G 2320/0233* (2013.01); *G09G 2320/0271* (2013.01); *G09G 2320/0285* (2013.01); *G09G 2320/0295* (2013.01); *G09G 2320/045* (2013.01); *G09G 2320/0626* (2013.01); *G09G 2330/028* (2013.01)

(58) Field of Classification Search
CPC ..... G09G 3/3291; G09G 3/3233; G09G 2330/028; G09G 2320/0626; G09G 2320/045; G09G 2300/043; G09G 2320/0285; G09G 2320/0271; G09G 2320/0233; G09G 2300/0819; G09G 2320/0295
USPC ..... 345/76, 204
See application file for complete search history.

(56) References Cited

U.S. PATENT DOCUMENTS 8,462,100 B2 * 6/2013 Umezaki ..... G09G 3/342 345/100
8,665,185 B2 * 3/2014 Fan ..... G09G 3/3258 315/169.3
9,818,345 B2 * 11/2017 Shim ..... G09G 3/3258
(Continued)

FOREIGN PATENT DOCUMENTS

CN 102968954 A 3/2013
CN 103123774 A 5/2013
(Continued)

OTHER PUBLICATIONS

Office Action issued in Chinese Patent Application No. 201410490048.5 dated Aug. 29, 2016.

*Primary Examiner* — Grant Sitta
(74) *Attorney, Agent, or Firm* — Morgan, Lewis & Bockius LLP

(57) ABSTRACT

An organic light emitting display device includes a display panel which is operated in a sensing mode or display mode and is provided with a plurality of sub-pixels, wherein each sub-pixel includes a driving transistor driven in accordance with a differential voltage between data and reference voltages, and an organic light emitting diode which emits light by a current flowing in accordance with driving of the driving transistor; a first memory for storing a characteristic value of the driving transistor sensed from the sub-pixel by the sensing mode; and a panel driver for generating the reference voltage based on the characteristic value of the driving transistor for the display mode.

20 Claims, 8 Drawing Sheets

(56) References Cited

U.S. PATENT DOCUMENTS

2002/0180685 A1* 12/2002 Itakura ..... G09G 3/3688 345/100
2005/0093788 A1* 5/2005 Shin ..... G09G 3/3241 345/76
2005/0110720 A1* 5/2005 Akimoto ..... G09G 3/3233 345/76
2006/0290613 A1* 12/2006 Hong ..... G09G 3/325 345/76
2008/0024526 A1* 1/2008 Ko ..... G09G 3/3233 345/690
2010/0020007 A1* 1/2010 You ..... G02F 1/133603 345/102
2010/0134469 A1* 6/2010 Ogura ..... G09G 3/3291 345/211
2010/0188320 A1* 7/2010 Min ..... G09G 3/3291 345/80
2010/0214273 A1* 8/2010 Shirouzu ..... G09G 3/3233 345/205
2012/0169704 A1* 7/2012 Chung ..... G09G 3/3233 345/212
2013/0050292 A1* 2/2013 Mizukoshi ..... G09G 3/3291 345/690
2013/0063413 A1* 3/2013 Miyake ..... G09G 3/32 345/212
2013/0113779 A1* 5/2013 Yoon ..... G09G 3/3233 345/212
2013/0127692 A1 5/2013 Yoon et al.
2013/0147694 A1 6/2013 Kim et al.
2014/0022289 A1* 1/2014 Lee ..... G09G 3/3283 345/691
2014/0062331 A1* 3/2014 Nam ..... G09G 3/3233 315/226
2014/0240305 A1* 8/2014 Chae ..... G09G 3/3225 345/212
2017/0169770 A1* 6/2017 Tang ..... G09G 3/3607

FOREIGN PATENT DOCUMENTS

CN 103165079 A 6/2013
KR 10-2013-0066449 A 6/2013

* cited by examiner

ORGANIC LIGHT EMITTING DISPLAY DEVICE

CROSS REFERENCE TO RELATED APPLICATIONS

This application claims the benefit of the Korean Patent Application No. 10-2013-0160930 filed on Dec. 23, 2013, which is hereby incorporated by reference as if fully set forth herein.

BACKGROUND OF THE INVENTION

Field of the Disclosure

The present invention relates to an organic light emitting display device, and more particularly, to an organic light emitting display device which is capable of maintaining a uniform luminance between each of sub-pixels.

Discussion of the Related Art

An organic light emitting display device includes an organic light emitting layer which emits light by recombination of hole and electron, whereby the organic light emitting display device emits light in itself. Also, since the organic light emitting display device emits light in itself, there is no problem related with a viewing angle. In addition, the organic light emitting display device has advantages of rapid response speed and low power consumption. In this respect, the organic light emitting display device has been attracted as a next-generation flat panel display.

The organic light emitting display device may include a plurality of sub-pixels for displaying images. Each sub-pixel may include an organic light emitting diode having an organic light emitting layer between anode and cathode electrodes, and a pixel circuit for making the organic light emitting diode emit light. The pixel circuit may include a switching transistor, a driving transistor, and a capacitor. The switching transistor is switched by a gate signal, and the switching transistor supplies a data voltage to the driving transistor. The driving transistor is switched by a data voltage supplied from the switching transistor, and the driving transistor controls a current flowing to the organic light emitting diode, and also controls a light emission of the organic light emitting diode. The capacitor stores a voltage between gate and source terminals of the driving transistor, and switches the driving transistor by the use of stored voltage. The organic light emitting diode emits light by the current supplied from the driving transistor.

In the organic light emitting display device according to the related art, a characteristic variation of the driving transistor such as mobility and threshold voltage (Vth) of the driving transistor may occur in each sub-pixel due to a manufacturing deviation, whereby an amount of current for driving the organic light emitting diode may vary, and thus a luminance deviation may occur between each of sub-pixels. In order to overcome this problem, the Unexamined Korean Patent Publication Number P10-2013-0066449 having counterpart US 2013/0147694 A1 (hereinafter, referred to as related art document') discloses an external compensation technique for compensating the characteristic variation of sub-pixel by sensing the characteristic variation of sub-pixel from the outside of the sub-pixel and reflecting the sensing result on data of the sub-pixel.

In the above-mentioned related art document, the organic light emitting diode emits light by a current based on a differential voltage between a data voltage supplied to a gate electrode of driving transistor included in each sub-pixel and a reference voltage supplied to a source electrode of driving transistor, to thereby display desired images.

However, in the case of the related art document, the reference voltage having a constant DC level is generated from an external voltage supply, and is then supplied to all sub-pixels in common. Thus, even though a threshold voltage of the driving transistor included in each sub-pixel is compensated by a data correction, the reference voltage supplied to each sub-pixel is not uniform so that a luminance deviation occurs between each of the sub-pixels, which results in deterioration of luminance uniformity in a low grayscale level.

SUMMARY OF THE INVENTION

Accordingly, embodiments of the present invention are directed to an organic light emitting display device that substantially obviates one or more problems due to limitations and disadvantages of the related art.

An object of the present invention is to provide an organic light emitting display device which is capable of maintaining a uniform luminance between each of sub-pixels.

Another object of the present invention is to provide an organic light emitting display device which is capable of improving luminance uniformity in a low grayscale level by improving data charging characteristics for each sub-pixel or each unit pixel.

Additional features and advantages of the invention will be set forth in the description which follows, and in part will be apparent from the description, or may be learned by practice of the invention. The objectives and other advantages of embodiments of the invention may be realized and attained by the structure particularly pointed out in the written description and claims hereof as well as the appended drawings.

To achieve these and other advantages and in accordance with the purpose of the present invention, an organic light emitting display device includes a display panel which is operated in a sensing mode or display mode and is provided with a plurality of sub-pixels, wherein each sub-pixel includes a driving transistor driven in accordance with a differential voltage between data and reference voltages, and an organic light emitting diode which emits light by a current flowing in accordance with driving of the driving transistor; a first memory for storing a characteristic value of the driving transistor sensed from the sub-pixel by the sensing mode; and a panel driver for generating the reference voltage based on the characteristic value of the driving transistor for the display mode.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

On explanation about the embodiments of the present invention, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms.

Also, it should be understood that the term such as "include" or "have" does not preclude existence or possibility of one or more features, numbers, steps, operations, elements, parts or their combinations.

It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device according to embodiments of the present invention will be described in detail with reference to the accompanying drawings.

Figure 1:
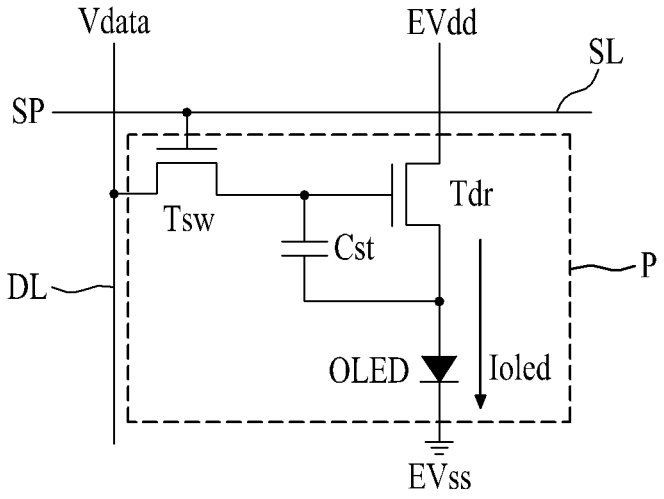
FIG. 1 Related Art
FIG. 1 is a circuit diagram showing a pixel structure of a related art organic light emitting display device.
Figure 2:
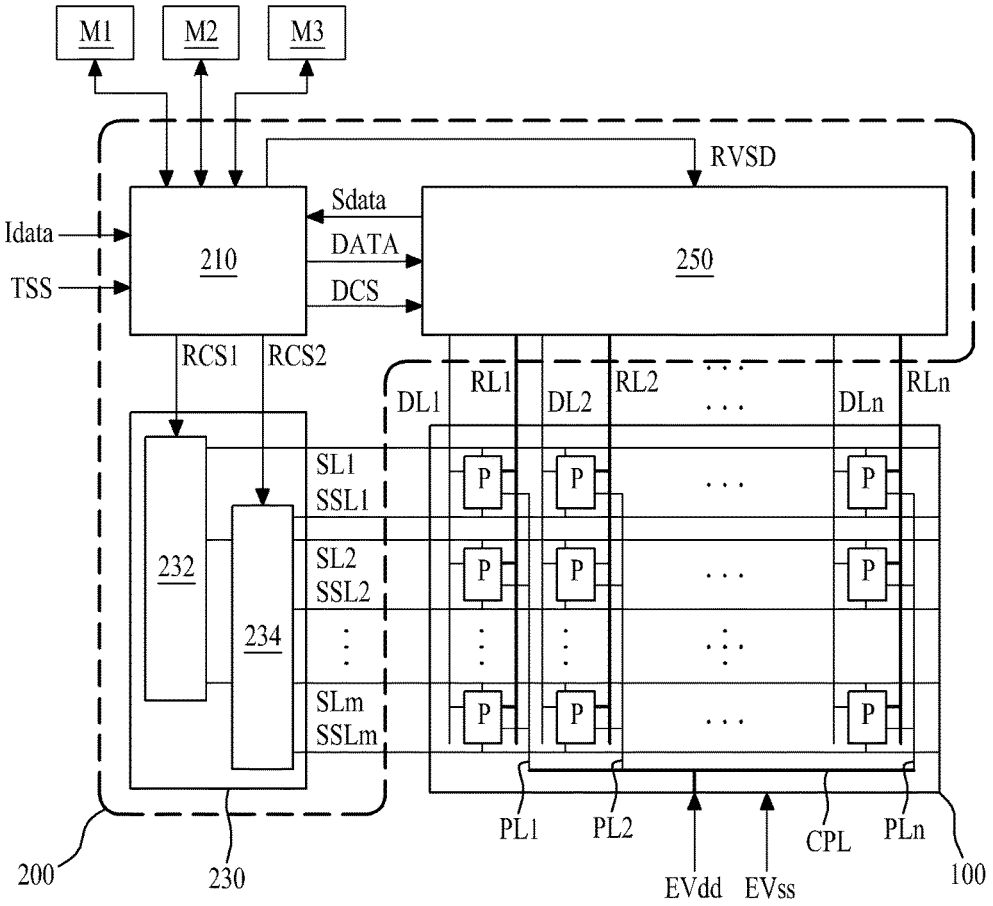
FIG. 2 illustrates an organic light emitting display device according to one embodiment of the present invention.
Figure 3:
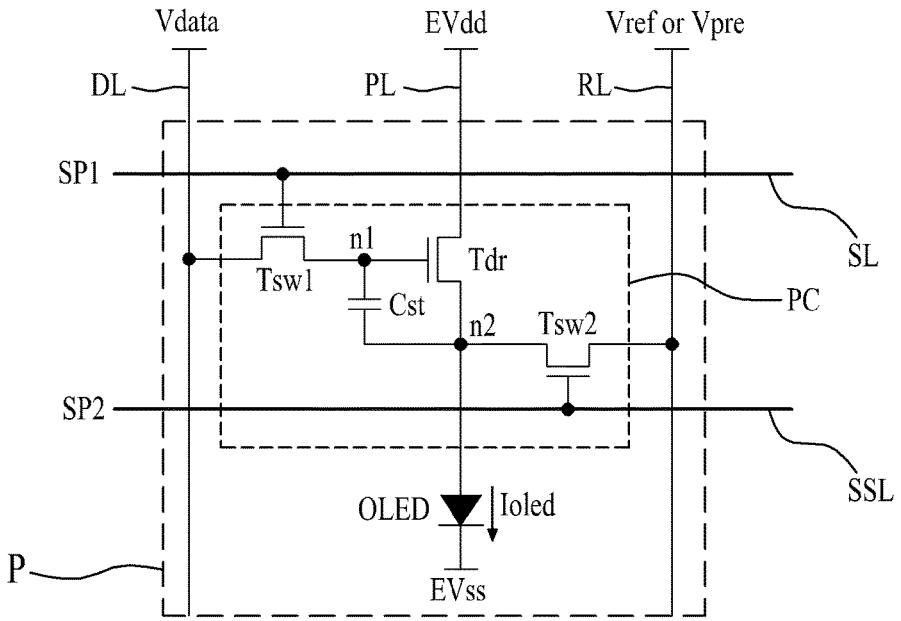
FIG. 3 illustrates a structure of each sub-pixel shown in FIG. 2.

FIG. 2 illustrates an organic light emitting display device according to one embodiment of the present invention. FIG. 3 illustrates a structure of each sub-pixel shown in FIG. 2.

With reference to FIGS. 2 and 3, the organic light emitting display device according to one embodiment of the present invention may include a display panel 100 and a panel driver 200.

The display panel 100 may include first to m-th scan control lines ('m' is aninteger, SL1 to SLm), first to m-th sensing control lines (SSL1 to SSLm), first to n-th data lines ('n' is an integer which is larger than 'm'), first to n-th reference lines (RL1 to RLn), first to n-th driving power lines (PL1 to PLn), a cathode electrode (not shown), and a plurality of sub-pixels (P). The display panel 100 may be driven in a sensing mode or a display mode in accordance with the driving of panel driver 200. In this case, the sensing mode may be defined by the driving of the organic light emitting display device for sensing a characteristic value for each sub-pixel (P). The sensing mode may be performed at a user's preset time before or after shipment of products of the organic light emitting display device, or may be performed every preset time period. The preset time period may be a power-on/off time point of the organic light emitting display device. The display mode may be defined by the driving of the organic light emitting display device for displaying images in each sub-pixel (P) by correcting each of reference voltage (Vref) and data voltage supplied to the corresponding sub-pixel (P) on the basis of characteristic value for each sub-pixel (P) sensed in the sensing mode.

The first to m-th scan control lines (SL1 to SLm) may be formed in a first direction of the display panel 100, for example, the first to m-th scan control lines (SL1 to SLm) may be formed at fixed intervals along a horizontal direction of the display panel 100.

The first to m-th sensing control lines (SSL1 to SSLm) may be formed at fixed intervals in parallel with the scan control lines (SL1 to SLm).

The first to n-th data lines (DL1 to DLn) may be formed side by side to have constant intervals along a second direction of the display panel 100, that is, a vertical direction, thereby crossing the scan control lines (SL1 to SLm) and the sensing control lines (SSL1 to SSLm), respectively.

The first to n-th reference lines (RL1 to RLn) may be formed at fixed intervals while being in parallel with the first to n-th data lines (DL1 to DLn). Each of the first to n-th reference lines (RL1 to RLn) is individually connected with the sub-pixel (P) formed in each horizontal line corresponding to the length direction of each of the scan control lines (SL1 to SLm), and is also connected with the sub-pixel (P) formed in each vertical line corresponding to the length direction of each of the data lines (DL1 to DLn) in common.

The first to n-th driving power lines (PL1 to PLn) are formed at fixed intervals while being in parallel with the data lines (DL1 to DLn). In this case, the first to n-th driving power lines (PL1 to PLn) may be formed at fixed intervals while being in parallel with the scan control lines (SL1 to SLm). The respective first to n-th driving power lines (PL1 to PLn) may be connected with a driving power common line (CPL) formed in an upper side and/or lower side of the display panel 100 in common.

The cathode electrode may be formed on the entire surface of the display panel 100, or the cathode electrode may be provided with patterns formed at fixed intervals and being in parallel with the data lines (DL1 to DLn) or scan control lines (SL1 to SLm).

Each of the sub-pixels (P) is formed every pixel region defined by crossing between each of the first to m-th scan control lines (SL1 to SLm) and each of the first to n-th data lines (DL1 to DLn). Each of the sub-pixels (P) may be any one among red, green, blue and white sub-pixels. At least three sub-pixels (P) being adjacent to one another among the plurality of sub-pixels (P) constitute one unit pixel for displaying an image. For example, each unit pixel may include the red, green, blue and white sub-pixels being adjacent to one another, or may include the red, green and blue sub-pixels being adjacent to one another.

Each of the sub-pixels (P) may include an organic light emitting diode (OLED), and a pixel circuit (PC) with a driving transistor (Tdr) for controlling a current flowing in the organic light emitting diode (OLED) on the basis of a differential voltage (Vdata−Vref) between a data voltage (Vdata) and a reference voltage (Vref).

The pixel circuit (PC) may include a first switching transistor (Tsw1), a second switching transistor (Tsw2), the driving transistor (Tdr), and a capacitor (Cst). In this case, the transistors (Tsw1, Tsw2, Tdr) may correspond to thin film transistor (TFT), for example, a-Si TFT, poly-Si TFT, Oxide TFT, Organic TFT, and etc.

The first switching transistor (Tsw1) is switched by a first scan pulse (SP1) supplied to the scan control line (SL), whereby the first switching transistor (Tsw1) being switched outputs the data voltage (Vdata) supplied to the data line (DL). To this end, the first switching transistor (Tsw1) may include a gate electrode connected with the adjacent scan control line (SL), a source electrode connected with the adjacent data line (DL), and a drain electrode connected with a first node (n1) corresponding to a gate electrode of the driving transistor (Tdr).

The second switching transistor (Tsw2) is switched by a second scan pulse (SP2) supplied to the sensing control line (SSL), whereby the second switching transistor (Tsw2) being switched outputs a voltage (Vref or Vpre), supplied to the reference line (RL), to a second node (n2) corresponding to a source electrode of the driving transistor (Tdr). To this end, the second switching transistor (Tsw2) may include a gate electrode connected with the adjacent sensing control line (SSL), a source electrode connected with the adjacent reference line (RL), and a drain electrode connected with the second node (n2).

The capacitor (Cst) may include gate and source electrodes of the driving transistor (Tdr), that is, first and second electrodes connected between the first and second nodes (n1, n2). The first electrode of the capacitor (Cst) is connected with the first node (n1), and the second electrode of the capacitor (Cst) is connected with the second node (n2). After a differential voltage between the respective voltages supplied to the first and second node (n1, n2) is charged in the capacitor (Cst) in accordance with the switching of the first and second switching transistors (Tsw1, Tsw2), the driving transistor (Tdr) is switched in accordance with the charged voltage.

According as the driving transistor (Tdr) is turned-on by the voltage of the capacitor (Cst), it is possible to control an amount of current flowing to the organic light emitting diode (OLED) from the driving power line (PL). To this end, the driving transistor (Tdr) may include a gate electrode connected with the first node (n1), a source electrode connected with the second node (n2), and a drain electrode connected with the driving power line (PL).

The organic light emitting diode (OLED) emits monochromatic light with a luminance corresponding to a data current (Ioled) flowing in accordance with the driving of the driving transistor (Tdr). To this end, the organic light emitting diode (OLED) may include a first electrode (for example, anode electrode) connected with the second node (n2), an organic layer (not shown) formed on the first electrode, and a second electrode (for example, cathode electrode) connected with the organic layer. In this case, the organic layer may be formed in a deposition structure of hole transport layer/organic light emitting layer/electron transport layer or a deposition structure of hole injection layer/hole transport layer/organic light emitting layer/electron transport layer/electron injection layer. Furthermore, the organic layer may include a functional layer for improving light-emitting efficiency and/or lifespan of the organic light emitting layer. The second electrode may be individually connected with each of the sub-pixels (P), or may be connected with the plurality of sub-pixels (P) in common. The second electrode is supplied with a low-potential power (EVss).

The panel driver 200 may drive the display panel 100 in the accordance with the sensing mode or display mode.

For the sensing mode, the panel driver 200 operates the driving transistor (Tdr) in a source follow mode by fixing a gate voltage for each of the first and second switching transistors (Tsw1, Tsw2) included in each sub-pixel (P), and also senses a source voltage of the driving transistor (Tdr) through the reference line (RL), to thereby generate sensing data (Sdata). Then, a threshold voltage of the driving transistor (Tdr) for each sub-pixel is calculated based on the sensing data (Sdata), and the calculated threshold voltage is stored in a first memory (M1).

For the sensing mode, the panel driver 200 generates the reference voltage (Vref) on the basis of threshold voltage of the driving transistor (Tdr) for each sub-pixel (P) stored in the first memory (M1), and the data voltage (Vdata) for each sub-pixel (P) by correcting input data (Idata) for each sub-pixel. The panel driver 200 supplies the generated the reference voltage (Vref) and the data voltage (Vdata) to the corresponding sub-pixel (P), to thereby displaying images on the display panel 100.

The panel driver 200 may include a timing controller 210, a row driver 230, and a column driver 250.

The timing controller 210 operates each of the row driver 230 and column driver 250 in accordance with the sensing mode for sensing the threshold voltage, that is, the characteristic value of the driving transistor (Tdr) included in each sub-pixel (P) at user's preset time point or every preset time period. Also, the timing controller 210 operates each of the row driver 230 and column driver 250 in accordance with the display mode for displaying images on the display panel 100.

For the sensing mode, the timing controller 210 operates the driving transistor (Tdr) in the source follow mode, thereby generating reference voltage setting data (RVSD) for each sub-pixel (P), and also generating control signals (DCS, RCS1, RCS2) and sensing display data (DATA) for sensing the threshold voltage of the driving transistor (Tdr) for each sub-pixel (P). For example, for the sensing mode, the timing controller 210 generates the control signals (DCS, RCS1, RCS2) and sensing display data (DATA) for sensing the threshold voltage of the driving transistor (Tdr) for each sub-pixel (P), and also generates the reference voltage setting data (RVSD) for each sub-pixel (P) so as to set the reference voltage (Vref) as a reference level.

For the display mode, the timing controller 210 generates a data correction value on the basis of threshold voltage of the driving transistor (Tdr) for each sub-pixel (P) stored in the first memory (M1), generates display data (DATA) for each sub-pixel (P) by correcting video data (Idata) for each sub-pixel (P) input from an external driving system (or graphic card) in accordance with the corresponding data correction value, provides the generated display data (DATA) to the column driver 250, and generates data control signal (DCS) and first and second row control signals (RCS1, RCS2) for controlling the row driver 230 and the column driver 250 on the basis of timing synchronized signal (TSS) input from an external driving system (or graphic card).

The timing controller 210 generates the reference voltage setting data (RVSD) for each sub-pixel (P) every one horizontal period on the basis of threshold voltage of the driving transistor (Tdr) for each sub-pixel (P) stored in the first memory (M1).

In more detail, the timing controller 210 according to one embodiment of the present invention uses a preset algorithm so as to generate the reference voltage setting data (RVSD) for each sub-pixel (P). That is, the timing controller 210 generates the reference voltage setting data (RVSD) for each sub-pixel (P) on the basis of threshold voltage of the driving transistor (Tdr) for each sub-pixel (P) stored in the first memory (M1) through the use of preset algorithm, and provides the generated reference voltage setting data (RVSD) to the column driver 250. For example, the timing controller 210 according to one embodiment of the present invention calculates a result value by subtracting the threshold voltage (Vth) of the driving transistor (Tdr) from a reference value (X) which is larger than 0 (zero), and generates the reference voltage setting data (RVSD) corresponding to the result value (X-Vth). In this case, the reference value (X) is preset to a constant value corresponding to a black voltage margin among the threshold voltages (Vth) of the driving transistor (Tdr) for all the sub-pixels (P) stored in the first memory (M1). The result value (X-Vth) to be larger than 0 (zero) should be considered when presetting the reference value (X).

When generating the reference voltage setting data (RVSD) for each sub-pixel (P), the timing controller 210 according to another embodiment of the present invention may store the reference voltage setting data (RVSD) for each sub-pixel (P), generated by the aforementioned algorithm, in a second memory (M2), and then provide the reference voltage setting data (RVSD) for each sub-pixel (P) stored in the second memory (M2) to the column driver 250. In this case, the timing controller 210 according to another embodiment of the present invention may load and store the reference voltage setting data (RVSD) for each sub-pixel (P), which is stored in the second memory (M2), in a third memory (M3) every power-on time period of the organic light emitting display device, and then provide the reference voltage setting data (RVSD) for each sub-pixel (P) of the corresponding horizontal line stored in the third memory (M3) to the column driver 250 as the unit of each horizontal period.

The first memory (M1) may be a flash memory mounted on a printed circuit board (PCB) which is provided inside the timing controller 210 or provided with the timing controller 210. Also, the second memory (M2) may be a flash memory mounted on a printed circuit board (PCB) which is provided inside the timing controller 210 or provided with the timing controller 210. The third memory (M3) is a memory mounted on a printed circuit board (PCB), that is, a memory whose data transmission speed is relatively rapid, for example, RAM (Random Access Memory) or DDRRAM (Double Data Rate Random Access Memory).

Meanwhile, the timing controller 210 may load and store the threshold voltage (Vth) of the driving transistor (Tdr) for each sub-pixel (P), which is stored in the first memory (M1), in the third memory (M3) every power-on time period of the organic light emitting display device, and also generate the display data (DATA) for each sub-pixel (P) on the basis of threshold voltage of the driving transistor (Tdr) for each sub-pixel (P) of the corresponding horizontal line stored in the third memory (M3) as the unit of each horizontal period.

The row driver 230 may include a scan line driver 232, and a sensing line driver 234.

The scan line driver 232 is connected with one side and/or the other side of each of the first to m-th scan control lines (SL1 to SLm). The scan line driver 232 generates the first scan pulse (SP1) in response to the first row control signal (RCS1) according to the sensing mode or display mode supplied from the timing controller 210, and supplies the generated first scan pulse (SP1) to the first to m-th scan control lines (SL1 to SLm). For example, in case of the sensing mode, the scan line driver 232 generates the first scan pulse (SP1) with a constant pulse width, and sequentially supplies the generated first scan pulse (SP1) to the first to m-th scan control lines (SL1 to SLm). In case of the display mode, the scan line driver 232 generates the first scan pulse (SP1) with a pulse width corresponding to a data addressing period for each horizontal period, and sequentially supplies the generated first scan pulse (SP1) to the first to m-th scan control lines (SL1 to SLm).

The sensing line driver 234 is connected with one side and/or the other side of each of the first to m-th sensing control lines (SSL1 to SSLm). The sensing line driver 234 generates the second scan pulse (SP2) in response to the second row control signal (RCS2) according to the sensing mode or display mode supplied from the timing controller 210, and supplies the generated second scan pulse (SP2) to the first to m-th sensing control lines (SSL1 to SSLm). For example, in case of the sensing mode, the sensing line driver 234 generates the second scan pulse (SP2) with a pulse width which is partially overlapped with the first scan pulse (SP1), and sequentially supplies the generated second scan pulse (SP2) to the first to m-th sensing control lines (SSL1 to SSLm). In case of the display mode, the sensing line driver 234 generates the second scan pulse (SP2) with a pulse width corresponding to a data addressing period for each horizontal period, and sequentially supplies the generated second scan pulse (SP2) to the first to m-th sensing control lines (SSL1 to SSLm).

For the sensing mode, the first and second scan pulses (SP1, SP2) may vary in type according to the pixel arrangement structure and the sensing method for sensing the threshold voltage (Vth) of the driving transistor (Tdr).

The column driver 250 is connected with the first to n-th data lines (DL1 to DLn) and the first to n-th reference lines (RL1 to RLn), and the column driver 250 is operated in the sensing mode or display mode under the mode control of the timing controller 210.

For the sensing mode, in response to the data control signal (DCS) of the sensing mode supplied from the timing controller 210, the column driver 250 generates the sensing data (Sdata) by sensing the source voltage of the driving transistor (Tdr) included in each sub-pixel (P) through the reference line (RL1 to RLn), and provides the generated sensing data (Sdata) to the timing controller 210.

For the display mode, in response to the data control signal (DCS) of the display mode supplied from the timing controller 210, the column driver 250 converts the display data (DATA) for each sub-pixel (P) of one horizontal line supplied from the timing controller 210 into the data voltage (Vdata), and supplies the data voltage (Vdata) to the corresponding data line (DL1 to DLn). At the same time, the column driver 250 converts the reference voltage setting data (RVSD) for each sub-pixel (P) of one horizontal line supplied from the timing controller 210 into the reference voltage (Vref) for each sub-pixel (P), and supplies the reference voltage (Vref) for each sub-pixel (P) to the corresponding reference line (RL1 to RLn).

Figure 4:
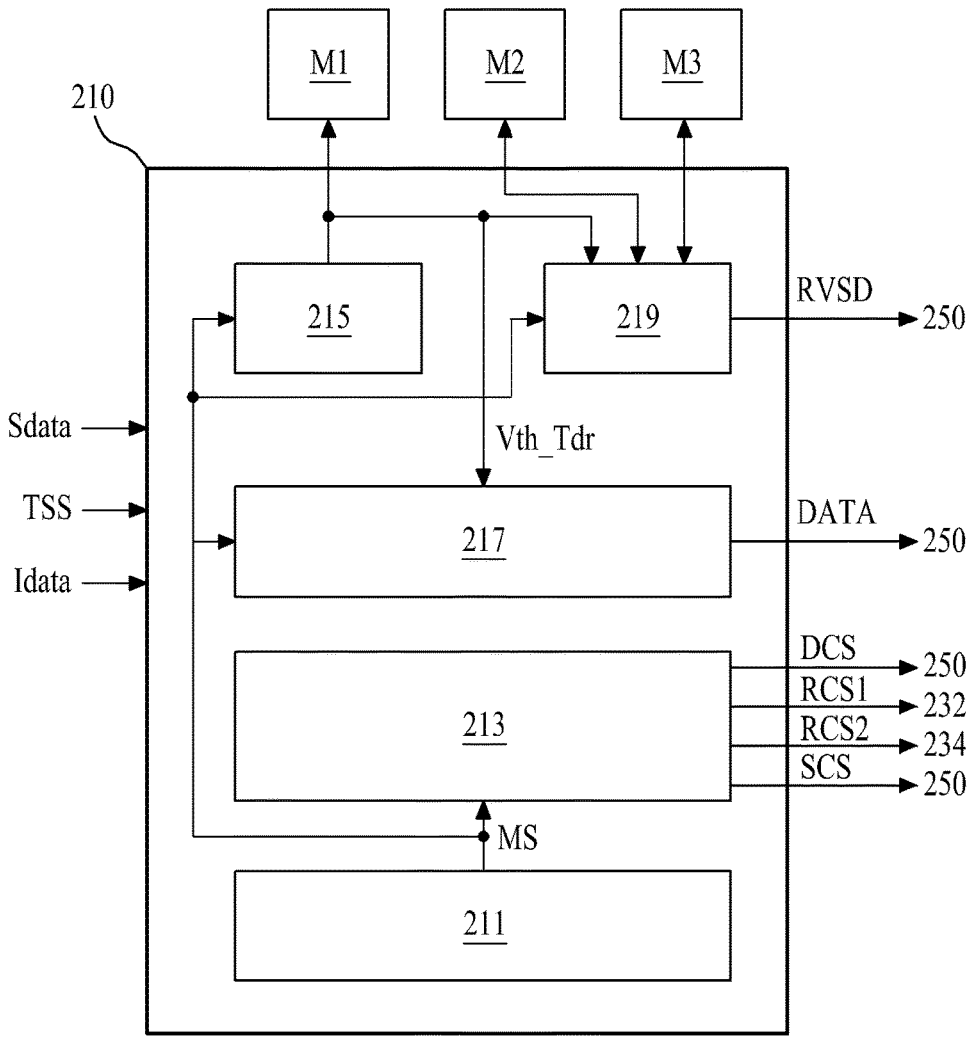
FIG. 4 is a block diagram showing a timing controller according to one embodiment of the present invention.

FIG. 4 is a block diagram showing the timing controller according to one embodiment of the present invention.

With reference to FIG. 4 in connection with FIGS. 2 and 3, the timing controller 210 according to one embodiment of the present invention may include a mode setting part 211, a control signal generating part 213, a sensing data processing part 215, a data processing part 217, and a reference voltage setting part 219.

The mode setting part 211 generates a mode signal (MS) of a first logic state for the sensing mode at a user's preset time or every preset time period. For example, the mode setting part 211 generates the mode signal (MS) of the first logic state if the mode setting part 211 receives a user's input signal for the sensing mode, or a sensing period signal according to a frame counting result of a vertically synchronized signal. If the mode setting part 211 does not receive the above signal, the mode setting part 211 generates a mode signal (MS) of a second logic state.

The control signal generating part 213 generates the first and second row control signals (RCS1, RCS2) corresponding to the sensing mode or display mode in accordance with the mode signal (MS) on the basis of timing synchronized signal (TSS) such as vertically synchronized signal, horizontally synchronized signal, data enable signal and main clock, and provides the generated first and second row control signals (RCS1, RCS2) to the row driver 230. At the same time, the control signal generating part 213 generates the data control signal (DCS), and provides the generated data control signal (DCS) to the column driver 250. The control signal generating part 213 generates a switching control signal (SCS) in accordance with the sensing mode or display mode of the mode signal (MS), and provides the switching control signal (SCS) to the column driver 250.

In accordance with the sensing mode of the mode signal (MS), the sensing data processing part 215 receives the sensing data (Sdata) for each sub-pixel (P) provided from the column driver 250, calculates the threshold voltage (Vth_Tdr) of the driving transistor (Tdr) for each sub-pixel (P) corresponding to the received sensing data (Sdata) for each sub-pixel (P), and stores the calculated threshold voltage (Vth_Tdr) in the first memory (M1).

In accordance with the sensing mode of the mode signal (MS), the data processing part 217 generates the sensing display data (DATA) for sensing the threshold voltage of the driving transistor (Tdr) included in each sub-pixel (P), and provides the generated sensing display data (DATA) to the column driver 250. In accordance with the display mode of the mode signal (MS), the data processing part 217 generates alignment data, which is obtained by aligning the input data (Idata) input from the external driving system (or graphic card) according to the pixel arrangement structure of the display panel 100, and generates the display data (DATA) for each sub-pixel (P) by correcting the alignment data on the basis of threshold voltage (Vth_Tdr) of the corresponding driving transistor (Tdr) stored in the first memory (M1). That is, for the display mode, the data processing part 217 reads the threshold voltage (Vth_Tdr) of the driving transistor (Tdr) being in one-to-one correspondence with the alignment data from the first memory (M1), calculates a data compensation value corresponding to the threshold voltage (Vth_Tdr) of the driving transistor (Tdr) for each sub-pixel (P), and generates the display data (DATA) for each sub-pixel (P) by correcting the corresponding alignment data in accordance with the calculated data compensation value. Then, the data processing part 217 provides the display data (DATA) for each sub-pixel (P) to the column driver 250 in accordance with a preset data interface method.

Additionally, if one unit pixel includes the red, green, blue and white sub-pixels (P), the data processing part 217 converts input data (Idata) of red, green and blue colors into four-color data of red, green, blue and white colors by a four-color data conversion method which is preset based on the luminance characteristics for each unit pixel in accordance with the luminance and/or driving characteristics for each sub-pixel (P), and then corrects the four-color data in accordance with the threshold voltage (Vth_Tdr) of the driving transistor (Tdr) included in each of the red, green, blue and white sub-pixels (P). In this case, the data processing part 217 may convert input data (Idata) of red, green and blue colors into four-color data of red, green, blue and white colors in accordance with data conversion method disclosed in the Unexamined Publication Number P10-2013-0060476 or P10-2013-0030598 in the Korean Intellectual Property Office.

The reference voltage setting part 219 generates the reference voltage setting data (RVSD) for each sub-pixel (P) every one horizontal period on the basis of threshold voltage of the driving transistor (Tdr) stored in the first or third memory (M1, M3), and then provides the generated reference voltage setting data (RVSD) to the column driver 250.

The reference voltage setting part 219 according to one embodiment of the present invention may calculate the result value by subtracting the threshold voltage (Vth) of the driving transistor (Tdr) from the reference value (X) which is larger than 0 (zero) in accordance with the preset algorithm, generate the reference voltage setting data (RVSD) corresponding to the result value (X-Vth), and provide the generated reference voltage setting data (RVSD) to the column driver 250.

The reference voltage setting part 219 according to another embodiment of the present invention may calculate the reference voltage setting data (RVSD) for each sub-pixel (P) through the algorithm calculation of the sensing mode, store the calculated reference voltage setting data (RVSD) for each sub-pixel (P) in the second memory (M2), read the reference voltage setting data (RVSD) for each sub-pixel (P) as the unit of horizontal line from the second memory (M2) or third memory (M3) of the display mode, and provide the reference voltage setting data (RVSD) for each sub-pixel (P) to the column driver 250.

Figure 5:
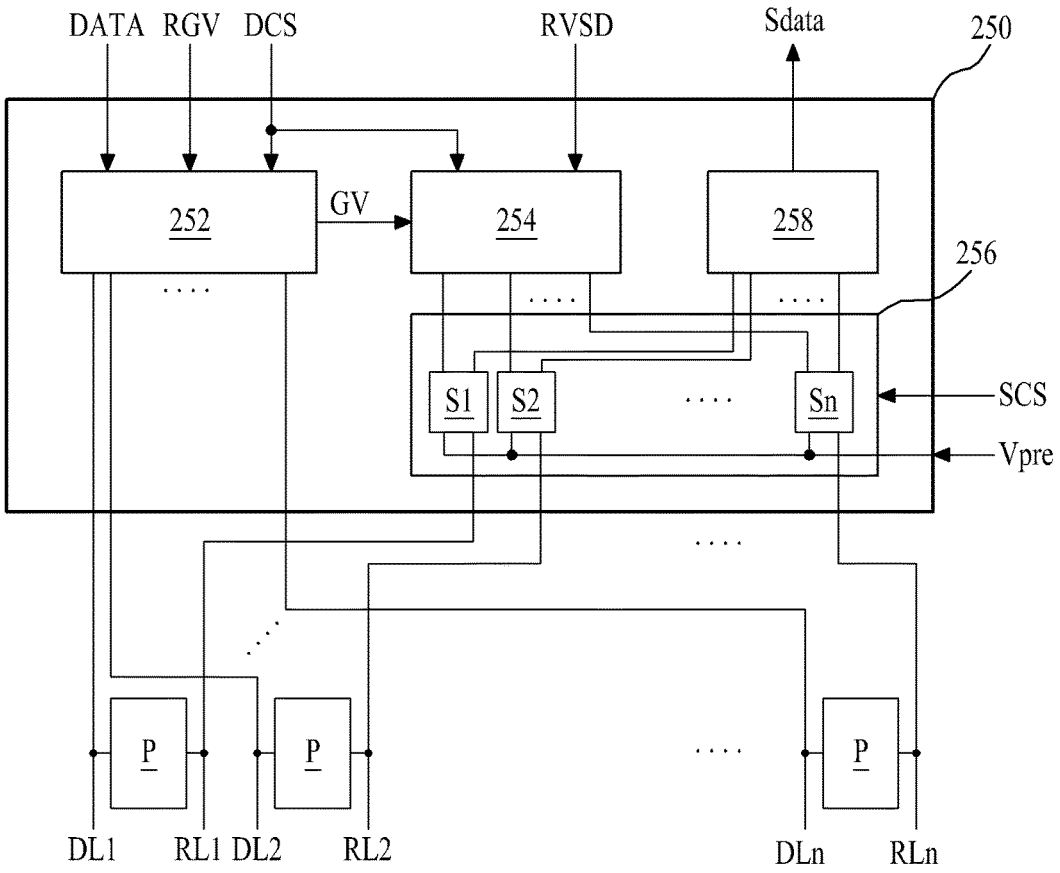
FIG. 5 illustrates a column driver according to one embodiment of the present invention shown in FIG. 2.

FIG. 5 illustrates the column driver according to one embodiment of the present invention shown in FIG. 2.

With reference to FIG. 5 in connection with FIGS. 2 and 3, the column driver 250 according to one embodiment of the present invention may include a data driving part 252, a reference voltage supply part 254, a switch part 256, and a sensing part 258.

The data driving part 252 converts the display data (DATA) supplied from the timing controller 210 into the data voltage (Vdata) in response to the data control signal (DCS) supplied from the timing controller 210 in accordance with the sensing mode or display mode, and supplies the data voltage (Vdata) to the corresponding data line (DL1 to DLn). To this end, the data driving part 252 may include a shift register, a latch, a grayscale voltage generator, and a digital-to-analog converter.

The shift register shifts a source start signal of the data control signal (DCS) in accordance with a source shift clock, and sequentially outputs a sampling signal. The latch sequentially samples and latches the display data (DATA) in accordance with the sampling signal, and simultaneously outputs the latch data of one horizontal line in accordance with a source output enable signal of the data control signal (DCS). The grayscale voltage generator generates a plurality of grayscale voltages (GV) corresponding to the number of grayscales of the display data (DATA) by a plurality of externally-provided reference gamma voltages (RGV). The digital-to-analog converters selects the grayscale voltage corresponding to the latch data among the plurality of grayscale voltages (GV) supplied from the grayscale voltage generator, uses the selected grayscale voltage as the data voltage (Vdata), and outputs the selected grayscale voltage to the corresponding data line (DL1 to DLn). The data driving part 252 supplies the data voltage (Vdata) corresponding to the display data (DATA) of the display mode to the data line (DL1 to DLn), and supplies the sensing data voltage (Vdata) preset in the sensing mode to the data line (DL1 to DLn).

The reference voltage supply part 254 converts the reference voltage setting data (RVSD) for each sub-pixel (P) supplied from the timing controller 210 every one horizontal period into the reference voltage (Vref) in response to the data control signal (DCS) supplied from the timing controller 210 in accordance with the sensing mode or display mode, and supplies the reference voltage (Vref) to the corresponding reference line (RL1 to RLn). To this end, the reference voltage supply part 254 may include first to n-th analog-to-digital converters. Each of the first to n-th analog-to-digital converters selects the grayscale voltage (GV) corresponding to the reference voltage setting data (RVSD) among the plurality of grayscale voltages (GV) supplied from the grayscale voltage generator, uses the selected grayscale voltage (GV) as the reference voltage (Vref), and outputs the reference voltage (Vref).

The switching part 256 is connected with the first to n-th reference lines (RL1 to RLn). In response to the switching control signal (SCS) supplied from the timing controller 210 in accordance with the sensing mode or display mode, the switching part 256 connects the reference line (RL1 to RLn) with the reference voltage supply part 254 or sensing part 258, or supplies the externally-provided pre-charging voltage (Vpre) to the first to n-th reference lines (RL1 to RLn). To this end, the switching part 256 may include first to n-th switching circuits (S1 to Sn) being switched in accordance with the switch control signal (SCS).

For the sensing mode, each of the first to n-th switching circuits (S1 to Sn) is switched to supply the pre-charging voltage (Vpre) to the first to n-th reference lines (RL1 to RLn) for a first period, to make the first to n-th reference lines (RL1 to RLn) be floating for a second period, and to connect the first to n-th reference lines (RL1 to RLn) to the sensing part 258 for a third period. For the display mode, each of the first to n-th switching circuits (S1 to Sn) is switched to connect the first to n-th reference lines (RL1 to RLn) with the reference voltage supply part 254 for the data addressing period, whereby the reference voltage (Vref) for each sub-pixel (P) is supplied to the corresponding reference line (RL1 to RLn).

For the sensing mode, the sensing part 258 is connected with the first to n-th reference lines (RL1 to RLn) through the switching part 256, whereby the sensing part 258 senses the voltage of each of the first to n-th reference lines (RL1 to RLn), generates the sensing data (Sdata) corresponding to the sensed voltage and provides the generated sensing data (Sdata) to the timing controller 210. To this end, the sensing part 258 may include first to n-th analog-to-digital converters connected with the first to n-th reference lines (RL1 to RLn) through the switching part 256.

Figure 6:
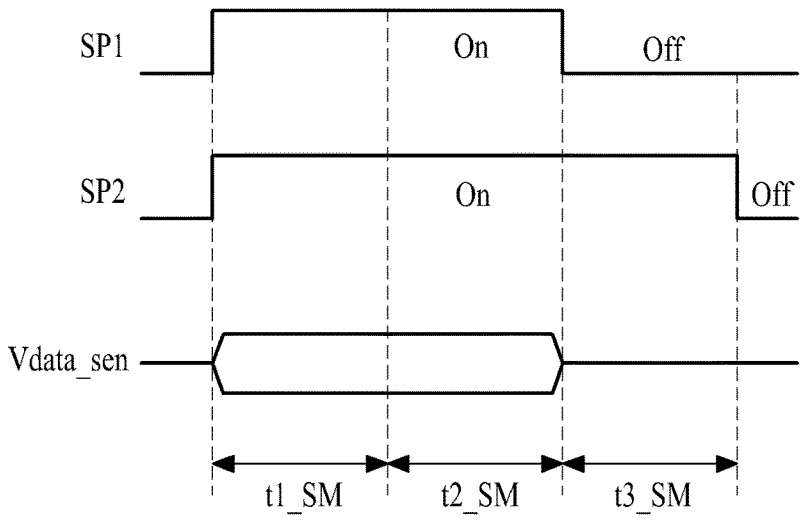
FIG. 6 is a waveform diagram for explaining an operation of the sub-pixel for a sensing mode in the organic light emitting display device according to one embodiment of the present invention.

FIG. 6 is a waveform diagram for explaining an operation of the sub-pixel for the sensing mode in the organic light emitting display device according to one embodiment of the present invention.

First, one sub-pixel is operated for a first period (t1_SM), a second period (t2_SM), and a third period (t3_SM).

For the sensing mode, the timing controller 210 generates sensing display data (DATA)) for sensing the threshold voltage of the driving transistor (Tdr) for each sub-pixel (P), provides the generated sensing display data (DATA) to the column driver 250, and generates the data control signal (DCS) and first and second row control signals (RCS1, RCS2) for controlling each of the row driver 230 and the column driver 250 in the sensing mode on the basis of timing synchronized signal (TSS). For the sensing mode, the timing controller 210 generates the switching control signal (SCS) for switching the switching part 256 of the column driver 250 in accordance with each of the first to third periods (t1, t2, t3).

For the sensing mode, the row driver 230 generates the first scan pulse (SP1) of gate-on voltage in accordance with the first row control signal (RCS1), and supplies the generated first scan pulse (SP1) to the scan control line (SL) for the first and second periods (t1, t2). At the same time, the row driver 230 generates the second scan pulse (SP2) of gate-on voltage in accordance with the second row control signal (RCS2), and supplies the generated second scan pulse (SP2) to the sensing control line (SSL) in accordance with the first, second and third periods (t1, t2, t3).

For the sensing mode, the column driver 250 converts the sensing display data (DATA) into the sensing data voltage (Vdata_sen) by the driving of the data driving part 252 in accordance with the data control signal (DCS), and supplies the sensing data voltage (Vdata_sen) to the corresponding data line (DL) for the first and second periods (t1, t2). Also, the column driver 250 supplies the pre-charging voltage (Vpre) to the reference line (RL1 to RLn) by the switching of the switching part 256 in accordance with the switching control signal (SCS) for the first period (t1_SM); makes the reference line (RL1 to RLn) be floating for the second period (t2_SM); and generates the sensing data (Sdata) by sensing the threshold voltage of the driving transistor (Tdr) for the corresponding sub-pixel (P) through the reference line (RL1 to RLn), and provides the generated sensing data (Sdata) to the timing controller 210 for the third period (t3_SM).

A method for driving the sub-pixel of the sensing mode will be described with reference to FIGS. 2 to 6.

For the first period (t1_SM), the sensing data voltage (Vdata), which is supplied to the data line (DL), is supplied to the first node (n1), that is, gate electrode of the driving transistor (Tdr) according as the first switching transistor (Tsw1) is turned-on by the first scan pulse (SP1) of the gate-on voltage; and the pre-charging voltage (Vpre), which is supplied to the reference line (RL), is supplied to the second node (n2), that is, source electrode of the driving transistor (Tdr) according as the second switching transistor (Tsw2) is turned-on by the second scan pulse (SP2) of the gate-on voltage. In this case, the sensing data voltage (Vdata) has a level of a target voltage which is preset to sense the threshold voltage of the driving transistor (Tdr). Accordingly, for the first period (t1_SM), the source voltage of the driving transistor (Tdr) and the reference line (RL) are initialized to the pre-charging voltage (Vpre).

For the second period (t2_SM), the reference line (RL) is switched to the floating state in accordance with the switching of the switching part 256 under the condition that each of the first and second switching transistors (Tsw1, Tsw2) is operated in a linear driving mode by the scan pulse (SP1, SP2) of the gate-on voltage. Accordingly, the driving transistor (Tdr) is operated in a saturation driving mode by the sensing data voltage (Vdata) corresponding to a bias voltage supplied to the gate electrode, whereby the reference line (RL) of the floating state is charged with the differential voltage (Vdata−Vth) between the data voltage (Vdata) and the threshold voltage (Vth) of the driving transistor (Tdr).

For the third period (t3_SM), under the condition that the second switching transistor (Tsw2) is maintained in the turning-on state, the first switching transistor (Tsw1) is turned-off by the first scan pulse (SP1) of gate-off voltage, and the reference line (RL) is connected with the sensing part 258 by the switching part 256, simultaneously. Accordingly, the sensing part 258 senses the voltage charged in the reference line (RL), generates the sensing data (Sdata) by converting the sensed voltage through the analog-digital conversion, and provides the generated sensing data (Sdata) to the timing controller 210.

Accordingly, the timing controller 210 calculates the threshold voltage (Vth_Tdr) of the driving transistor (Tdr) on the basis of the data voltage (Vdata) and the sensing data (Sdata) provided from the sensing part 258, and stores the threshold voltage (Vth_Tdr) of the driving transistor (Tdr) in the first memory (M1). In this case, the threshold voltage (Vth_Tdr) of the driving transistor (Tdr) may be obtained by subtracting the sensing voltage of the sensing part 258 from the data voltage (Vdata).

Figure 7:
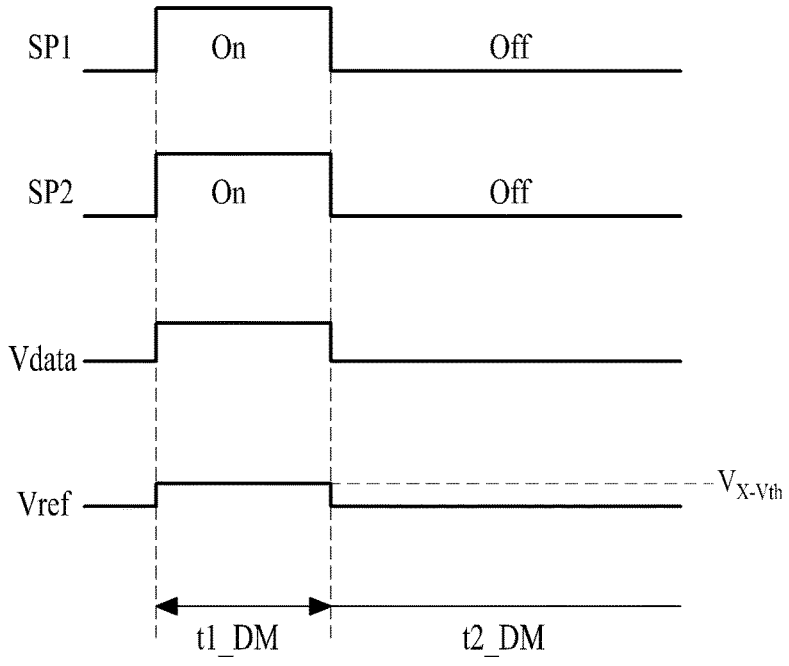
FIG. 7 is a waveform diagram for explaining an operation of the sub-pixel for a display mode in the organic light emitting display device according to one embodiment of the present invention.

FIG. 7 is a waveform diagram for explaining an operation of the sub-pixel for the display mode in the organic light emitting display device according to one embodiment of the present invention.

First, one sub-pixel is operated for a data addressing period (ti_DM) and a light emitting period (t2_DM).

For the display mode, the timing controller 210 generates the display data (DATA) for each sub-pixel (P) by correcting the video data (Idata) for each sub-pixel (P) on the basis of threshold voltage of the driving transistor (Tdr) for each sub-pixel (P) stored in the first memory (M1), provides the generated display data (DATA) to the column driver 250, and generates the data control signal (DCS) and the first and second row control signals (RCS1, RCS2) for controlling the row driver 230 and the column driver 250 in the display mode on the basis of timing synchronized signal (TSS). Also, the timing controller 210 generates the reference voltage setting data (RVSD) for each sub-pixel (P) every one horizontal period on the basis of threshold voltage of the driving transistor (Tdr) for each sub-pixel (P) stored in the first memory (M1). The timing controller 210 generates the switching control signal (SCS) for switching the switching part 256 of the column driver 250 in accordance with the data addressing period (t1_DM) and the light emitting period (t2_DM).

For the display mode, the row driver 230 generates the first scan pulse (SP1) of gate-on voltage in accordance with the first row control signal (RCS1), and supplies the generated first scan pulse (SP1) to the scan control line (SL) for the data addressing period (t1_DM). At the same time, the row driver 230 generates the second scan pulse (SP2) of gate-on voltage in accordance with the second row control signal (RCS2), and supplies the generated second scan pulse (SP2) to the sensing control line (SSL) for the data addressing period (t1_DM).

For the display mode, the column driver 250 converts the display data (DATA) into the data voltage (Vdata) by the driving of the data driving part 252 in accordance with the data control signal (DCS), and supplies the data voltage (Vdata) to the corresponding data line (DL) for the data addressing period (t1_DM). Also, the column driver 250 generates the reference voltage (Vref) by converting the reference voltage setting data (RVSD) for each sub-pixel (P) in the digital-analog conversion by the driving of the reference voltage supply part 254, and supplies the generated reference voltage (Vref) to the corresponding reference line (RL1 to RLn) in accordance with the switching of the switching part 256 for the data addressing period (t1_DM).

A method for driving the sub-pixel of the display mode will be described with reference to FIGS. 2 to 5 and FIG. 7.

For the data addressing period (t1_DM), the data voltage (Vdata), which is supplied to the data line (DL), is supplied to the first node (n1), that is, gate electrode of the driving transistor (Tdr) according as the first switching transistor (Tsw1) is turned-on by the first scan pulse (SP1) of the gate-on voltage; and the reference voltage (Vref), which is supplied to the reference line (RL), is supplied to the second node (n2), that is, source electrode of the driving transistor (Tdr) according as the second switching transistor (Tsw2) is turned-on by the second scan pulse (SP2) of the gate-on voltage. Accordingly, the capacitor (Cst) connected with the first and second nodes (n1, n2) is charged with the differential voltage (Vdata−Vref) between the data voltage (Vdata) and the reference voltage (Vref). In this case, the data voltage (Vdata) charged in the capacitor (Cst) includes the voltage for compensating the threshold voltage of the corresponding driving transistor (Tdr). The reference voltage (Vref) has a voltage level ($V_{X\text{-}Vth}$) corresponding to the reference voltage setting data (RVSD) set based on the threshold voltage of the corresponding driving transistor (Tdr).

For the light emitting period (t2_DM), the first and second switching transistors (Tsw1, Tsw2) are respectively turned-off by the first and second scan pulses (SP1, SP2) of the gate-off voltage. Accordingly, the driving transistor (Tdr) is turned-on by the voltage (Vdata−Vref) stored in the capacitor (Cst). Thus, the data current (Ioled), which is determined by the differential voltage (Vdata−Vref) between the data voltage (Vdata) and the reference voltage (Vref), flows in the organic light emitting diode (OLED) by the turned-on driving transistor (Tdr) so that the organic light emitting diode (OLED) emits light in proportion to the data current (Ioled) flowing from the driving power line (PL) to the second electrode (or cathode electrode). That is, for the light emitting period (t2_DM), if the first and second switching transistors (Tsw1, Tsw2) are turned-off, the current flows in the driving transistor (Tdr). Then, the voltage of the second node (n2) is increased according as the organic light emitting diode (OLED) emits light in proportion to the current flowing in the driving transistor (Tdr), whereby the voltage of the first node (n1) is increased by the voltage increase of the second node (n2) through the use of capacitor (Cst). Accordingly, a gate-source voltage (Vgs) of the driving transistor (Tdr) is continuously maintained by the voltage of the capacitor (Cst), and the organic light emitting diode (OLED) maintains the light emission until the addressing period (t1_DM) of the next frame.

Figure 8:
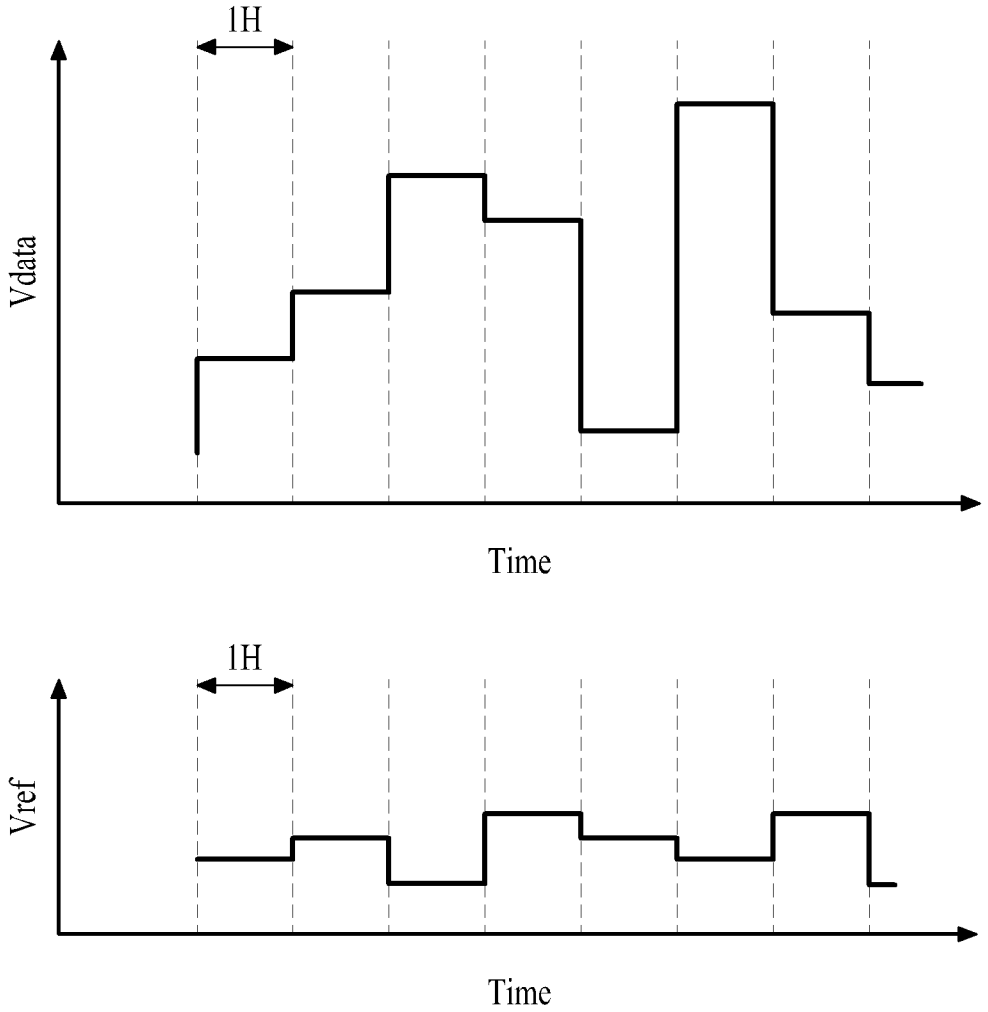
FIG. 8 is a waveform diagram showing one example of data and reference voltages supplied to the random sub-pixel every horizontal period in the organic light emitting display device according to one embodiment of the present invention.

FIG. 8 is a waveform diagram showing one example of data and reference voltages supplied to the random sub-pixel every horizontal period in the organic light emitting display device according to one embodiment of the present invention.

As shown in FIG. 8, in case of the display mode of the organic light emitting display device according to one embodiment of the present invention, the reference voltage supplied to the sub-pixel (P) is not fixed to the constant level, but changed every horizontal period on the basis of threshold voltage of the corresponding driving transistor (Tdr). Accordingly, it is possible to maintain the uniform luminance between each of the sub-pixels (P) by changing the reference voltage (Vref), and also to improve luminance uniformity in a low grayscale by improving the data charging characteristics of the sub-pixel (P).

Figure 9:
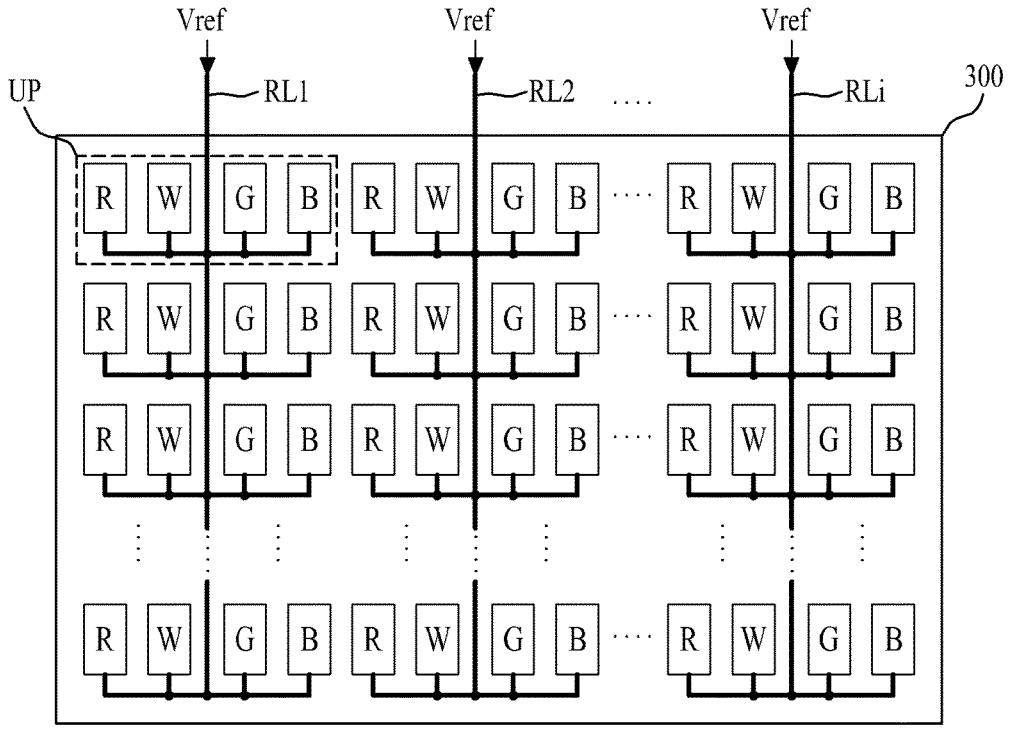
FIG. 9 illustrates a reference line connected with a unit pixel formed in a display panel of an organic light emitting display device according to another embodiment of the present invention.

FIG. 9 illustrates a reference line connected with a unit pixel formed in a display panel of an organic light emitting display device according to another embodiment of the present invention. In FIG. 9, four sub-pixels constituting one unit pixel (UP) uses one reference line in common, whereby the number of reference lines (RL) is reduced by ¼. Hereinafter, only different structures will be described in detail.

First, in case of the above organic light emitting display device according to one embodiment of the present invention, the reference voltage (Vref) varies every sub-pixel (P), and there are the first to n-th reference lines (RL1 to RLn) individually connected with the sub-pixels (P) formed in each horizontal line on the display panel 100, whereby it needs the reference lines (RL) whose number corresponds to the number of sub-pixels (P) formed in the horizontal line.

Meanwhile, as shown in FIG. 9, the organic light emitting display device according to another embodiment of the present invention may include first to i-th reference lines (RL1 to RLi) individually connected with the unit pixel (UP) formed in each horizontal line so that the reference voltage (Vref) varies every unit pixel.

Each of the first to i-th reference lines (RL1 to RLi) is connected with red (R), white (W), green (G) and blue (B) sub-pixels constituting the unit pixel (UP) in common. Accordingly, the reference voltage (Vref) supplied to each of the first to i-th reference lines (RL1 to RLi) every horizontal period is supplied to the red (R), white (W), green (G) and blue (B) sub-pixels constituting the unit pixel (UP) in common.

As shown above, in the organic light emitting display device according to another embodiment of the present invention, the reference voltage (Vref) varies every unit pixel (UP). Thus, the threshold voltage of the driving transistor (Tdr) included in each of the red (R), white (W), green (G) and blue (B) sub-pixels constituting the unit pixel (UP) may be sequentially sensed by one reference line (RL1 to RLi) for the aforementioned sensing mode.

For the sensing mode, the panel driver 200 shown in FIG. 2 generates sensing data (Sdata) for each sub-pixel by sequentially performing first to fourth sensing blocks which are set every horizontal line, and sequentially sensing the threshold voltages of the driving transistors (Tdr) included in the sub-pixels (R, W, G, B) constituting each unit pixel (UP); calculates the threshold voltage of the driving transistor for each sub-pixel corresponding to the generated sensing data (Sdata) for each sub-pixel; and stores the calculated threshold voltage of the driving transistor for each sub-pixel in a first memory (M1). In detail, a timing controller 210 controls a row driver 230 and a column driver 250 so that first and second scan pulses (SP1, SP2) and a sensing data voltage (Vdata_sen) are supplied to a corresponding scan control line, a corresponding sensing control line and a corresponding data line. In each of the first to fourth sensing blocks, as mentioned above, the driving transistors (Tdr) included in the sub-pixels (R, W, G, B) constituting each unit pixel (UP) are operated in a source follow mode, whereby the threshold voltages of the driving transistors (Tdr) are sensed through the corresponding reference line (RL).

Also, since the sub-pixels (R, W, G, B) constituting the unit pixel (UP) are connected with one reference line (RL), the panel driver 200 calculates a representative value for each unit pixel (UP) from the threshold voltages of the driving transistors (Tdr) of the respective sub-pixels (R, W, G, B) constituting the unit pixel (UP), and changes the reference voltage (Vref) on the basis of the calculated representative value.

In detail, the panel driver 200, that is, a reference voltage setting part 219 of the timing controller 210 shown in FIG. 4 calculates the representative value for each unit pixel (UP) by the use of average value of the threshold voltages of the driving transistors (Tdr) for the respective sub-pixels included in each unit pixel (UP), average value except minimum and maximum values of the threshold voltages of the driving transistors (Tdr) for the respective sub-pixels included in each unit pixel (UP), or minimum value of the threshold voltages of the driving transistors (Tdr) for the respective sub-pixels included in each unit pixel (UP) on the basis of the threshold voltage of the driving transistor for each sub-pixel stored in the first or third memory (M1, M3); and generates reference voltage setting data (RVSD) for each unit pixel (UP) on the basis of comparison result obtained by comparing the calculated representative value with a reference value.

For example, the reference voltage setting part 219 according to one embodiment of the present invention calculates a result value by subtracting the representative value (Vth_UP) for each unit pixel from the reference value (X) which is larger than 0 (zero), that is, predetermined algorithm; generates the reference voltage setting data (RVSD) corresponding to the result value (X-Vth_UP); and provides the generated reference voltage setting data (RVSD) to the column driver 250. In this case, as mentioned above, the result value (X-Vth_UP) to be larger than 0 (zero) should be considered when presetting the reference value (X).

The reference voltage setting part 219 according to another embodiment of the present invention may calculate the reference voltage setting data (RVSD) for each unit pixel (UP) by the aforementioned algorithm calculation for the sensing mode; store the calculated reference voltage setting data (RVSD) in a second memory (M2); read the reference voltage setting data (RVSD) of each unit pixel (UP) as the unit of horizontal line from the second or third memory (M2, M3) for the display mode; and provide the read reference voltage setting data (RVSD) for each unit pixel (UP) to the column driver 250.

With reference to FIGS. 5 and 9, a reference voltage supply part 254 of the column driver 250 converts the reference voltage setting data (RVSD) for each unit pixel (UP) supplied from the timing controller 210 every one horizontal period into a reference voltage (Vref) for each unit pixel (UP) in response to a data control signal (DCS) supplied from the timing controller 210 in accordance with the sensing mode or display mode, and provides the reference voltage (Vref) for each unit pixel (UP) to the corresponding reference line (RL1 to RLi). To this end, the reference voltage supply part 254 may include first to i-th analog-to-digital converters. Each of the first to n-th analog-to-digital converters selects a grayscale voltage (GV) corresponding to the reference voltage setting data (RVSD) for each unit pixel (UP) among a plurality of grayscale voltages (GV) supplied from a grayscale voltage generator of a data driving part 252, uses the selected grayscale voltage (GV) as the reference voltage (Vref) for each unit pixel (UP), and outputs the reference voltage (Vref) for each unit pixel (UP). The reference voltage (Vref) for each unit pixel (UP) output from the reference voltage supply part 254 is supplied to the corresponding reference line (RL1 to RLi) through a switching part 256. In this case, the switching part 256 may include 'i' switching circuits respectively connected with the first to i-th reference lines (RL1 to RLi).

For the sensing mode, a sensing part 258, which is connected with the first to i-th reference lines (RL1 to RLi) through the switching part 256, senses a voltage for each of the first to i-th reference lines (RL1 to RLi) every first to fourth sensing block of each horizontal line, and provides sensing data (Sdata) for each sub-pixel included in the unit pixel (UP) corresponding to the sensed voltage to the timing controller 210.

FIG. 9 illustrates that the unit pixel (UP) connected with each of the first to i-th reference lines (RL1 to RLi) includes the red (R), white (W), green (G) and blue (B) sub-pixels, but not limited to this structure. For example, one unit pixel (UP) may include at least three sub-pixels among red (R), white (W), green (G), blue (B), sky blue, and deep blue sub-pixels.

The above embodiments of the present invention are not limited to the pixel structure shown in FIG. 3. The embodiments of the present invention may be applied all kinds of pixel circuit for driving the driving transistor (Tdr) through the use of differential voltage between the data and reference voltages.

According to the present invention, the reference voltage (Vref) for each sub-pixel (P) is changed based on the threshold voltage of the driving transistor (Tdr) of the sub-pixel (P) so that it is possible to realize the uniform luminance between each of the sub-pixels (P), and also to improve the luminance uniformity in the low grayscale by the improved data charging characteristics of the sub-pixel (P).

According to the present invention, the reference voltage (Vref) for each unit pixel (UP) is changed based on the threshold voltage of the driving transistor (Tdr) of the sub-pixel so that it is possible to realize the uniform luminance between each of the sub-pixels, to improve the luminance uniformity in the low grayscale by the improved data charging characteristics of the sub-pixel, and also to reduce the number of reference lines (RL).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device, comprising:

a display panel configured to be operated in a sensing mode or display mode comprising a plurality of sub-pixels, each sub-pixel comprising:

a driving transistor configured to be driven in accordance with a differential voltage between a data voltage and a reference voltage in a first period of the sensing mode or in a data addressing period of the display mode, the data voltage and the reference voltage being simultaneously supplied to different electrodes of the driving transistor, with a storage capacitor connected between the different electrodes; and an organic light emitting diode configured to emit light by a current flowing in accordance with driving of the driving transistor;

a first memory configured to store a characteristic value of the driving transistor sensed from the sub-pixel by the sensing mode; and a panel driver configured to:

generate reference voltage setting data in accordance with a comparison result obtained by comparing the characteristic value of the driving transistor for the display mode with a reference value greater than 0 (zero); and convert the reference voltage setting data into the reference voltage, wherein the reference value is set within a range enabling the comparison result be greater than 0 (zero).

2. The organic light emitting display device according to claim 1, wherein the panel driver is further configured to generate a data voltage of the corresponding sub-pixel by correcting input data of the sub-pixel based on the characteristic value of the driving transistor for the display mode.

3. The organic light emitting display device according to claim 2, wherein the panel driver comprises:

a timing controller configured to:

generate the reference voltage setting data and at least one data compensation value based on the characteristic value of the driving transistor; and generate display data for the sub-pixel by correcting input data of the sub-pixel in accordance with the corresponding data compensation value; and a column driver configured to:

convert the display data into the data voltage; and convert the reference voltage setting data into the reference voltage.

4. The organic light emitting display device according to claim 3, wherein:

the display panel further comprises a reference line individually connected to the sub-pixel formed in one horizontal line; and the column driver comprises:

a data driving part configured to convert the display data into the data voltage;

a sensing part configured to:

sense the characteristic value of the driving transistor included in the corresponding sub-pixel through the reference line; and supply the sensed characteristic value of the driving transistor to the timing controller to store the sensed characteristic value of the driving transistor in the first memory;

a reference voltage supply part configured to:

convert the reference voltage setting data into the reference voltage; and supply the reference voltage to the reference line; and a switching part configured to connect the reference line to the sensing part or reference voltage supply part.

5. The organic light emitting display device according to claim 4, wherein the timing controller is further configured to generate the reference voltage setting data in accordance with a comparison result obtained by comparing the characteristic value of the driving transistor with the reference value.

6. The organic light emitting display device according to claim 3, wherein:

the display panel further comprises a reference line individually connected to a unit pixel including at least three adjacent sub-pixels formed in one horizontal line, and connected to the sub-pixels included in the unit pixel in common; and the column driver comprises:

a data driving part configured to convert the display data into the data voltage;

a sensing part configured to:

sense the characteristic value of the driving transistor included in the corresponding sub-pixel through the reference line; and supply the sensed characteristic value of the driving transistor to the timing controller to store the sensed characteristic value of the driving transistor in the first memory;

a reference voltage supply part configured to:

convert the reference voltage setting data into the reference voltage; and supply the reference voltage to the reference line; and a switching part configured to connect the reference line to the sensing part or reference voltage supply part.

7. The organic light emitting display device according to claim 6, wherein the timing controller is further configured to:

calculate a representative value of the unit pixel based on the characteristic value of the driving transistor stored in the first memory; and generate the reference voltage setting data based on the calculated representative value of the unit pixel.

8. The organic light emitting display device according to claim 7, wherein the timing is further configured to generate the reference voltage setting data based on a comparison result obtained by comparing the representative value of the unit pixel with the reference value.

9. The organic light emitting display device according to claim 3, further comprising:

a second memory configured to store the reference voltage setting data, wherein the timing controller is further configured to:

read the reference voltage setting data stored in the second memory for the display mode, and provide the reference voltage setting data to the column driver.

10. The organic light emitting display device according to claim 3, further comprising:

a second memory configured to store the reference voltage setting data; and a third memory of RAM (Random Access Memory) or DDRRAM (Double Data Rate Random Access Memory), wherein the timing controller is further configured to:

read the reference voltage setting data, stored in the second memory, every power-on time period of the organic light emitting display device, and store the read reference voltage setting data in the third memory, read the reference voltage setting data, stored in the third memory, for the display mode, and provide the read reference voltage setting data to the column driver.

11. The organic light emitting display device according to claim 1, wherein:

the display panel further comprises a plurality of driving power lines configured to supply a respective driving power to each sub-pixel; and the driving transistor comprises:

a gate electrode configured to supply the data voltage;

a source electrode configured to supply the reference voltage; and a drain electrode configured to supply the driving power.

12. The organic light emitting display device according to claim 1, wherein the characteristic value of the driving transistor is a threshold voltage.

13. An organic light emitting display device, comprising a display panel comprising a plurality of sub-pixels, each sub-pixel comprising:

a driving transistor configured to be driven in accordance with a differential voltage between a data voltage and a reference voltage in a first period of the sensing mode or in a data addressing period of the display mode, the data voltage and the reference voltage being simultaneously supplied to different electrodes of the driving transistor, with a storage capacitor connected between the different electrodes; and an organic light emitting diode configured to emit light by a current flowing in accordance with driving of the driving transistor, wherein the reference voltage is varied in accordance with reference voltage setting data based on a characteristic value of the driving transistor, wherein the reference voltage setting data:

is generated in accordance with a comparison result obtained by comparing the characteristic value of the driving transistor with a reference value greater than 0 (zero), and is converted into the reference voltage, and wherein the reference value is set within a range enabling the comparison result be greater than 0 (zero).

14. The organic light emitting display device according to claim 13, wherein the characteristic value of the driving transistor is a threshold voltage.

15. The organic light emitting display device according to claim 13, wherein:

the display panel further comprises a plurality of driving power lines configured to supply a driving power to each sub-pixel, each sub-pixel further comprising:

a first switching transistor configured to supply the data voltage to a gate electrode of the driving transistor;

a second switching transistor configured to supply the reference voltage to a source electrode of the driving transistor; and the storage capacitor connected between the gate electrode of the driving transistor and the source electrode of the driving transistor; and the driving power is supplied to a drain electrode of the driving transistor.

16. The organic light emitting display device according to claim 13, wherein:

the display panel further comprises a reference line individually connected to the sub-pixel formed in one horizontal line, the reference line being configured to individually supply the reference voltage to the sub-pixel; and the reference voltage for each sub-pixel is changed based on the characteristic value of the driving transistor of the sub-pixel.

17. The organic light emitting display device according to claim 16, wherein the characteristic value of the driving transistor is a threshold voltage.

18. The organic light emitting display device according to claim 13, wherein:

the display panel further comprises a reference line individually connected to a unit pixel including at least three adjacent sub-pixels in one horizontal line, the reference line being configured to supply the reference voltage to the sub-pixels included in the unit pixel in common; and the reference voltage for each unit pixel is changed by a representative value of the unit pixel based on the characteristic value of the driving transistor.

19. The organic light emitting display device according to claim 18, wherein the characteristic value of the driving transistor is a threshold voltage.

20. The organic light emitting display device according to claim 19, wherein the representative value of the unit pixel is an average value of the threshold voltages of the driving transistors for respective sub-pixels included in each unit pixel, the average value comprising:

a value other than minimum and maximum values of the threshold voltages of the driving transistors for the respective sub-pixels included in each unit pixel; or a minimum value of the threshold voltages of the driving transistors for the respective sub-pixels included in each unit pixel.

* * * * *